US005328259A

United States Patent [19]

Meriaux

[11] Patent Number: 5,328,259

[45] Date of Patent: Jul. 12, 1994

[54] LOCKABLE HANGING FILE FOLDER

[76] Inventor: L. Charles Meriaux, 650 S. Westlake Blvd.- Ste. 104, Westlake Village, Calif. 91362

[21] Appl. No.: 103,720

[22] Filed: Aug. 10, 1993

[51] Int. Cl.[5] ..... B42F 15/00

[52] U.S. Cl. ..... 312/184; 402/47

[58] Field of Search ..... 312/184, 183, 9.54, 312/9.56; 211/46; 402/46, 47

[56] References Cited

U.S. PATENT DOCUMENTS

| | | | |
|---|---|---|---|
| 2,257,052 | 9/1941 | Hanna | 211/46 |
| 2,810,388 | 10/1957 | Conley et al. | 312/184 |
| 3,801,175 | 4/1974 | Giulie | 312/184 |
| 3,865,445 | 2/1975 | Dean et al. | 312/184 |
| 4,262,808 | 4/1981 | Laporte | 211/46 |
| 4,327,952 | 5/1982 | Cournoyer et al. | 312/184 |
| 4,703,982 | 11/1987 | Rock et al. | 312/330 R |

FOREIGN PATENT DOCUMENTS 664728 1/1952 United Kingdom .

*Primary Examiner*—Kenneth J. Dorner
*Assistant Examiner*—Gerald A. Anderson
*Attorney, Agent, or Firm*—Jack C. Munro

[57] ABSTRACT

A hanging file folder to be used within a drawer that is lockable in position within the drawer. Therefore, movement is prevented of the hanging file folder during normal opening and closing movement of the drawer.

5 Claims, 1 Drawing Sheet

LOCKABLE HANGING FILE FOLDER

BACKGROUND OF THE INVENTION

1) Field of the Invention

The field of this invention relates to a stationery product and more particularly to a hanging file folder that is used normally within a drawer with this hanging file folder to be used to store documents.

2) Description of the Prior Art

The use of hanging file folders within offices is exceedingly common. Typically, the hanging file folder is utilized within a drawer of a desk, a file cabinet or credenza. The drawer includes a pair of support rails located in a parallel evenly spaced apart arrangement. Between these rails, the hanging file folder is suspended. Each hanging file folder includes a pair of upper ends with the body of the hanging file folder assuming a V-formation. It is within the V-formation that one or more documents are to be contained for storage purposes. Within each upper end of the file folder is located a suspension bar. Each of these suspension bars terminate at their outer ends into hooks with these hooks in turn being supported on the rails. Normally, the file folders are to be readily movable on these rails.

Frequently the drawer is not completely filled with file folders. Therefore, during normal opening and closing movement of the drawer, the file folders tend to slide on the rails. Also, there is a tendency for the file folders to become skewed during opening and closing movement of the drawer. During the opening and closing movement of the drawer, not only do the file folders begin to slide together, compact and become skewed, the file folders can also become separated from their supporting rails. Generally this sliding movement of the file folders within the drawer is not desirable.

SUMMARY OF THE INVENTION

The primary objective of the present invention is to construct a locking mechanism in conjunction with a file folder that will lock that file folder in position within a drawer and prevent undesirable sliding movement of the file folder during opening and closing movement of the drawer.

Another objective of the present invention is to construct a file folder locking mechanism that is composed of few parts and can be manufactured inexpensively and therefore sold relatively inexpensively to the ultimate consumer.

Another objective of the present invention is to construct a file folder locking mechanism which can be operated simply by even the most unskilled individual.

Another objective of the present invention that by using the file folder locking mechanism of the present invention, the file folders within a drawer are always neatly in their preset location, even after multitudes of times of opening and closing of the drawer.

A typical file folder is constructed of a front panel and a rear panel with these panels being connected together at a lower edge forming a V-shaped configuration. The front panel is mounted onto a suspension bar with a rear panel being also similarly mounted onto a separate suspension bar. Each of these suspension bars terminate at their outer ends or in hooks and these hooks are to be supportingly retained on parallel spaced apart supporting rails with a hanging folder being located between these supporting rails. Mounted on one of the suspension bars is a lever, this lever pivotally movable between a locked position and unlocked position. Connected to this lever are a pair of rods with these rods extending in opposite directions. Movement of the lever from an unlocked position to a locked position causes these rods to move outwardly in opposite directions with one rod to physically contact one rail and the opposite rod to physically contact the other rail. The mounting position of the rods on the lever can be varied slightly so as to permit adjustment of the rods to adjust to different spacing between the rails so as to insure that at all times the rods will come into contact with the rails.

DETAILED DESCRIPTION OF THE SHOWN EMBODIMENT

Figure 1:
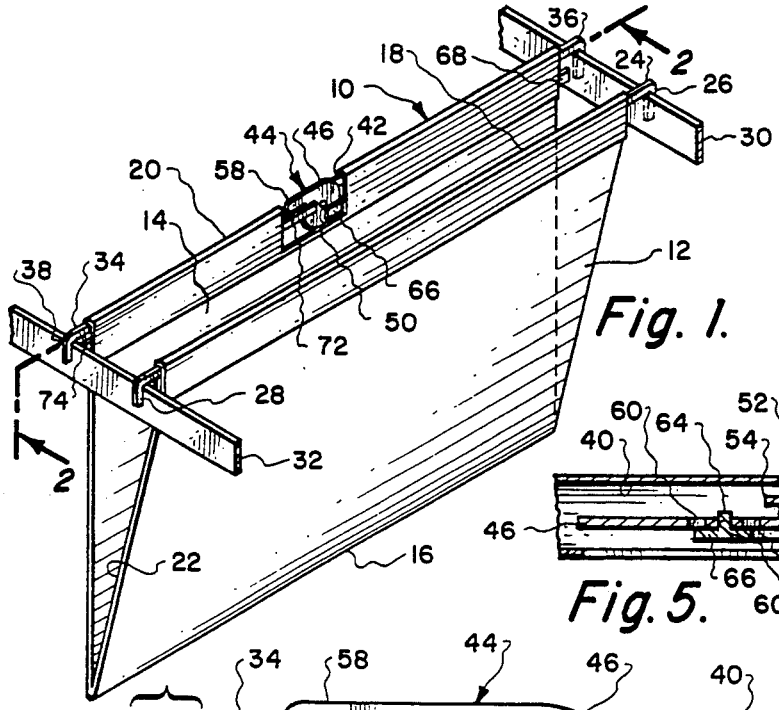
FIG. 1 is an isometric view of a typical hanging file folder supported between a pair of rails with this file folder including the locking mechanism of the present invention.
Figure 5:
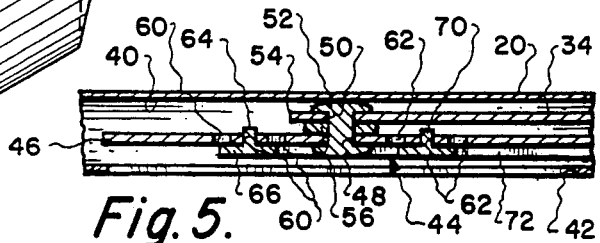
FIG. 5 is a cross-sectional view taken along line 5—5 of FIG. 4.

Referring in particular to the drawing there is shown a file folder 10 which is composed of a front panel 12 and a rear panel 14. Panels 12 and 14 are connected at their bottom edge 16. The upper end 18 of panel 12 and the upper end 20 of panel 14 are located in a spaced apart configuraton so the file folder 10 forms a pocket 22 in a V-shaped configuration. It is within the pocket 22 that articles are to be stored with the articles generally comprising stacks of paper such as letters, documents, and the like.

The upper end 18 is formed into an open-ended sleeve and within that sleeve is located a suspension bar 24. The suspension bar 24 terminates into a hook 26 at one end and into a similar hook 28 at the opposite end. Hook 26 is to rest on a rail 30 with hook 28 resting on a rail 32. Rails 30 and 32 are basically identical and are fixedly mounted on a supporting structure (not shown) in a spaced apart parallel arrangement. Typically the rails 30 and 32 will be mounted in conjunction with a drawer of a file cabinet, desk or other similar type of structure. It is to be understood that within this drawer and mounted on the rails 30 and 32 will be a plurality of the file folders 10 with only one file folder 10 being shown. The file folders will be located in an in-line manner on the rails 30 and 32.

The upper end 20 is also formed into a sleeve that is open-ended and within the upper end 20 is located a second suspension bar 34. One end of the suspension bar 34 is formed into a hook 36 which is to be mounted on the rail 30 with the opposite end of the suspension bar being formed into a hook 38 which is mounted on the rail 32. Normally the mounting by hooks 26, 28, 36 and 38 permit free sliding movement of the file folder 10 on the rails 30 and 32.

The sleeve which forms the upper end 20 includes an interior chamber 40. The suspension bar 34 is mounted within this interior chamber 40. Centrally located in the sleeve of the upper end 20 is a cutout 42. The function of this cutout 42 will be explained further on in .the specification.

During normal opening and closing movement of the drawer, the file folder 10 will have a tendency to slide along on rails 30 and 32. Generally this sliding movement is not desired. This sliding movement of the file folders 10 will automatically occur unless the drawer is absolutely packed with file folders 10.

It is desirable to stop this sliding movement. In order to do so, there is incorporated a locking mechanism 44 in conjunction with the file folder 10.

The locking mechanism 44 includes a lever 46 with an enlarged center section that has centrally located therein a hole 48. A rivet 50 is mounted within the hole 48 with rivet 50 also being secured within hole 52 formed within depending section 54 of the suspension bar 34. In between the depending section 54 and the lever 46 is located a washer 56 which functions as a spacer. The rivet 50 functions as a pivot pin permitting pivoting of the lever.46 relative to the depending section 54. Pivoting of the lever 46 is facilitated by means of outward extension 58 which functions as a handle. The lever 46, which includes the handle 58, is located within the cutout area 42.

Included within the main body section of the lever 46 are three in number of spaced apart holes 60 and another three in number spaced apart holes 62. The holes 60 are in radial alignment relative to the rivet 50 as well as the holes 62. The holes 60 are located diametrically opposite the holes 62 relative to the rivet 50. One of the holes 60 is to engage in a close fitting manner with a pin 64. The pin 64 is mounted on a rod 66. The pin 64, although close fitting within the holes 60, is capable of pivoting within the hole 60 as the lever 46 is pivoted relative to the depending section 54. The rod 66 includes an outer free end 68. The pin 64 is capable of connecting with any one of the holes 60.

Any one of the holes 62 is connectable with a pin 70. The pin 70 is mounted on a rod 72 which is essentially identical to rod 66. The rod 72 has an outer free end 74.

Figure 2:
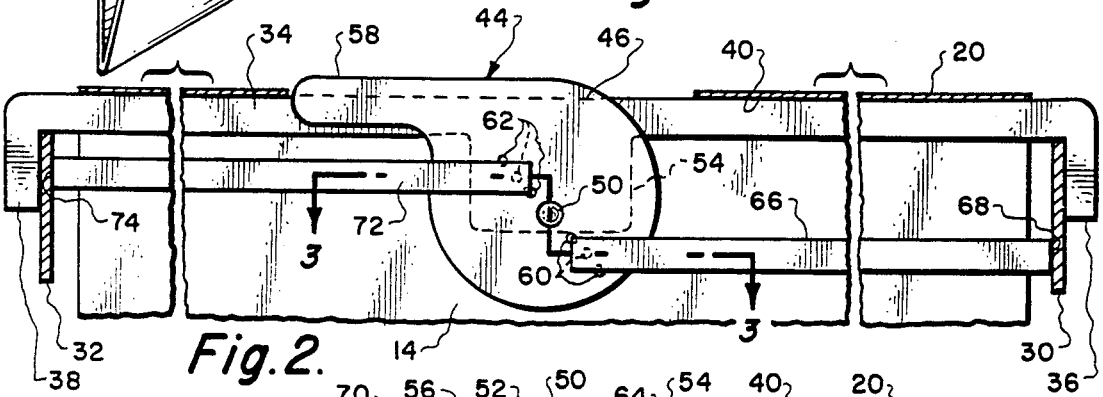
FIG. 2 is a cross-sectional view taken through one of the upper ends of the file folder showing the locking mechanism in conjunction therewith in the locked position.
Figure 3:
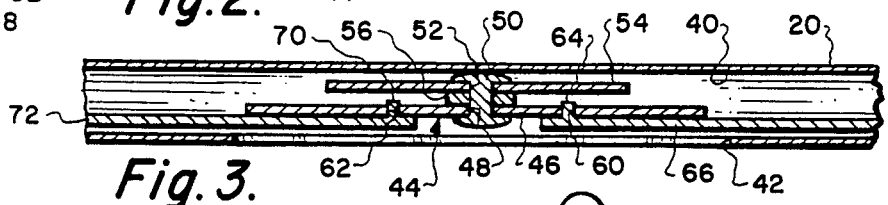
FIG. 3 is a cross-sectional view through the locking lever of the locking mechanism taken along line 3—3 of FIG. 2.
Figure 4:
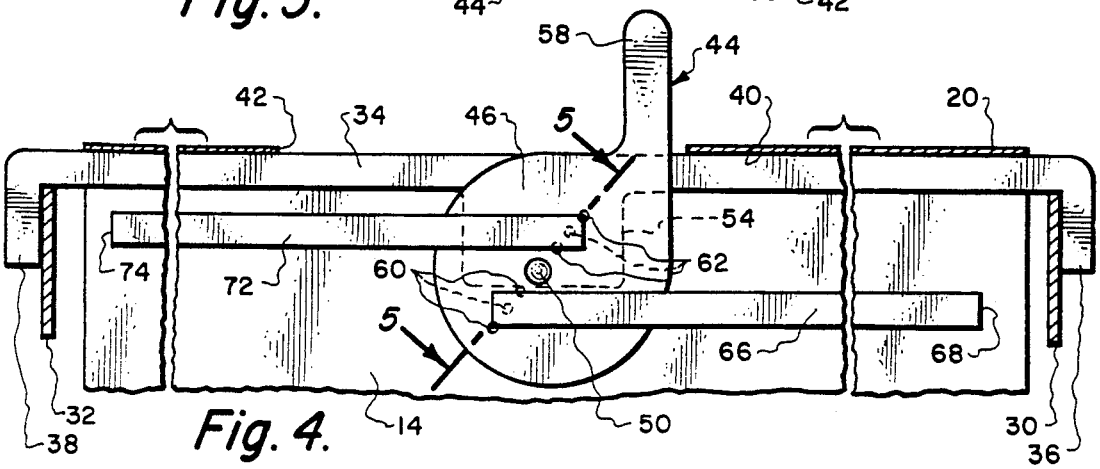
FIG. 4 is a view similar to FIG. 2 but showing the locking lever in the unlocked position.

With the lever 46 in the locked position as is shown in FIG. 2 of the drawing, the outer free ends 68 and 74 are to be in snug contact with their respective rails 30 and 32. If the rails 30 and 32 are spaced ever so slightly further apart and snug contact is not being obtained, the user can physically remove the pin 64 from the hole 60 shown in FIG. 2 and relocate the pin 64 in the hole 60 that is spaced furthest from the rivet 50. This relocating procedure is to be duplicated also for pin 70 and the furthest hole 62. The net result is when the lever 46 is in the locked position as shown in FIG. 2, the ends 68 and 74 will extend a slight distance further outward and therefore should come into contact with their respective rails 30 and 32.

If the rails 30 and 32 are located a little closer together than the normal distance, the user can then remove the pin 64 and relocate such in the hole 60 that is located closest to the rivet 50. This relocating procedure is to be similarly duplicated for pin 70 in the hole 62 that is located closest to the rivet 50. This will cause the end 68 and 74 to be moved ever so slightly in an inward direction toward each other so as to compensate for the decreased spacing between the rails 30 and 32 and yet permit the ends 68 and 74 to just come into snug contact with the respective rails 30 and 32. This adjustment procedure is desirable because not all the rails 30 and32 are located precisely the same distance apart within all drawers of desks and filing cabinets.

What is claimed is:

1. In combination with a hanging file folder, said hanging file folder being suspended in a V-formation between a pair of parallel and evenly spaced apart supporting rails, said file folder terminating in a pair of elongated upper ends which are supported by hook members at each end thereof on said rails, the improvement comprising:

a locking mechanism mounted in conjunction with one of said upper ends, said locking mechanism being movable between a locked position and an unlocked position, with said locking mechanism in said locked position the said upper end that has said locking mechanism is fixedly positioned to said rails, with said locking mechanism in said unlocked position siad file folder being readily movable on said rails; and said locking mechanism including a pair of rods, said rods being movable in a somewhat longitudinally aligned position relative to each other, one of said rods being movable into tight contact with one of said rails and the other of said rods being movable into tight contact with the remaining said rail.

2. In combination with a hanging file folder, said hanging file folder being suspended in a V-formation between a pair of parallel and evenly spaced apart supporting rails, said file folder terminating in a pair of elongated upper ends which are supported by hook members at each end thereof on said rails, the improvement comprising:

a locking mechanism mounted in conjunction with one of said upper ends, said locking mechanism being movable between a locked position and an unlocked position, with said locking mechanism in said locked position the said upper end that has said locking mechanism is fixedly positioned to said rails, with said locking mechanism in said unlocked position siad file folder being readily movable on said rails; and said locking mechanism including a lever, each said upper end including a suspension bar with each said suspension bar terminating at each end thereof into said hook members, said lever being pivotally mounted on a said suspension bar, movement of said lever between said locked position and said unlocked position results in simultaneous opposite movement of said rods.

3. In combination with a hanging file folder, said hanging file folder being suspended in a V-formation between a pair of parallel and evenly spaced apart supporting rails, said file folder terminating in a pair of elongated upper ends which are supported by hook members at each end thereof on said rails, the improvement comprising:

a locking mechanism mounted in conjunction with one of said upper ends, said locking mechanism being movable between a locked position and an unlocked position, with said locking mechanism in said locked position the said upper end that has said locking mechanism is fixedly positioned to said rails, with said locking mechanism in said unlocked position said file folder being readily movable on said rails;

said locking mechanism being manually movable between said locked position and said unlocked position; and said locking mechanism including a pair of rods, said rods being movable in a somewhat longitudinally aligned position relative to each other, one of said rods being movable into tight contact with one of said rails and the other of said rods being movable into tight contact with the remaining said rail.

4. The combination as defined in claim wherein:

said locking mechanism including a lever, each said upper end including a suspension bar with each said suspension bar terminating at each end thereof into said hook members, said lever being pivotally mounted on a said suspension bar, movement of said lever between said locked position and said unlocked position results in simultaneous opposite movement of said rods.

5. The combination as defined in claim 4 wherein:

each said rod being connectable at various positions on said lever so as to adjust the locking position of said rods on said rails.

* * * * *